United States Patent [19]

Perrone et al.

[11] 4,131,389

[45] Dec. 26, 1978

[54] CENTRIFUGAL COMPRESSOR WITH IMPROVED RANGE

[75] Inventors: George L. Perrone; Robert W. Boorman, both of Phoenix; Michael R. Holbrook, Glendale; Eugene A. Zanelli, Scottsdale, all of Ariz.

[73] Assignee: The Garrett Corporation, Los Angeles, Calif.

[21] Appl. No.: 790,718

[22] Filed: Apr. 25, 1977

Related U.S. Application Data

[63] Continuation-in-part of Ser. No. 636,255, Nov. 28, 1975, abandoned.

[51] Int. Cl.[2] ..... F04D 29/44

[52] U.S. Cl. ..... 415/211; 415/DIG. 1

[58] Field of Search ..... 415/53, 106, 116, 211, 415/DIG. 1

[56] References Cited

U.S. PATENT DOCUMENTS

| | | | |
|---|---|---|---|
| 2,453,524 | 11/1948 | McMahan et al. | 415/211 |
| 4,054,398 | 10/1977 | Penny | 415/211 |

FOREIGN PATENT DOCUMENTS

| | | | |
|---|---|---|---|
| 162580 | 9/1905 | Fed. Rep. of Germany | 415/211 |
| 963540 | 1/1950 | France | 415/DIG. 1 |

*Primary Examiner*—C. J. Husar
*Assistant Examiner*—Donald S. Holland
*Attorney, Agent, or Firm*—Herschel C. Omohundro; James W. McFarland; Albert J. Miller

[57] ABSTRACT

The subject compressor is of the centrifugal type having a rotatable impeller with hub and shroud sides and a diffuser surrounding the impeller, the diffuser having spaced side walls with vanes spaced around the impeller to provide passages for receiving fluid discharged from the impeller, the diffuser also having chambers formed on the hub and shroud sides and restricted openings along lines of static pressure in the diffuser passages establishing communication between the chambers and the diffuser passages near the inlet ends thereof whereby the pressures at such passage inlet ends will be equalized during the operation of the compressor and the tendency of the compressor to stall prematurely thereby reduced. Suitable communication between the chambers on the hub and shroud sides may be provided.

13 Claims, 2 Drawing Figures

CENTRIFUGAL COMPRESSOR WITH IMPROVED RANGE

BACKGROUND OF THE INVENTION

Figure 1:
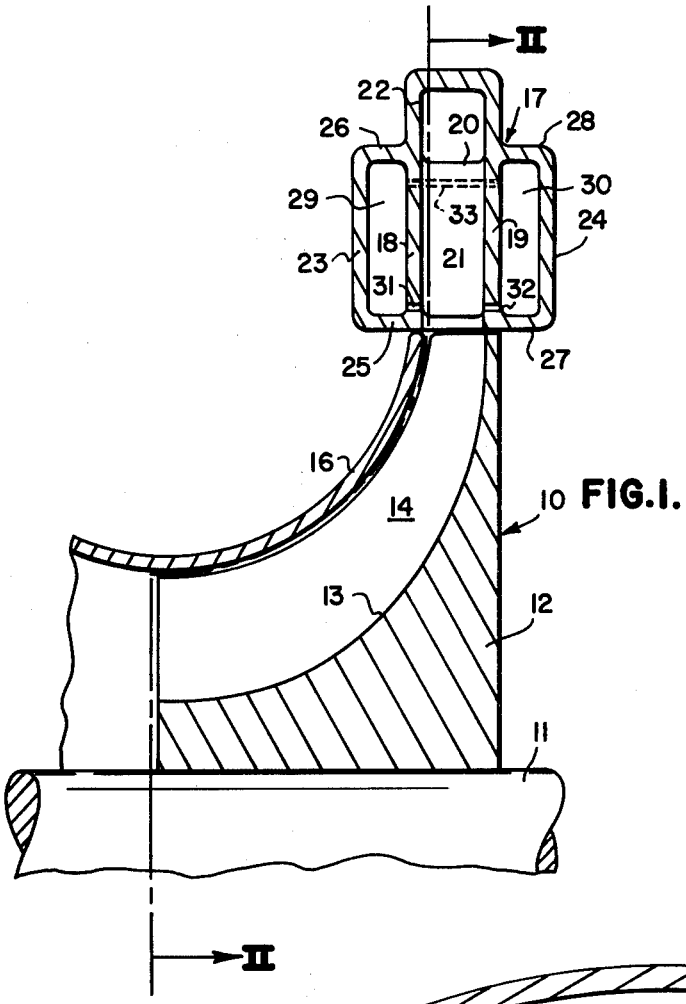

This is a continuation-in-part of co-pending U.S. patent application Ser. No. 636,255, filed Nov. 28, 1975, now abandoned.

This invention relates generally to rotary machinery and is more specifically directed to compressors of the type employed in gas turbine engines and pneumatic pressure generators, wherever employed. Still more specifically, the invention pertains to compressors of the centrifugal type in which a rotary impeller is provided and a diffuser is disposed around the periphery of the impeller to receive air therefrom and convert the velocity of the air into pressure. In the operation of such compressors there has been a tendency for the machine to enter into what is known in the trade as a stall or surge condition which impairs the efficiency of the machine, may limit the rate at which it can be operated and may also result in premature deterioration or damage to the machine. In some instances the surging condition may be prematurely precipitated by faulty construction, manufacturing tolerances and/or variable flow characteristics between different diffuser passages.

This type of compressors to which the present invention is directed is exemplified by the following patents:

U.S. Pat. No. 973,782 — Hayton
U.S. Pat. No. 2,453,524 — McMahan et al.
U.S. Pat. No. 2,656,096 — Schwarz
U.S. Pat. No. 2,660,366 — Kelin et al.
U.S. Pat. No. 2,706,510 — O'Connor The machines shown in these patents are subject to the surging condition mentioned above.

Prior attempts to increase the surge free operating range of a centrifugal compressor have centered about arrangements for removing or altering the flow boundary layer in the walls of the diffuser downstream of the compressor. Exemplary of such an attempt is French Pat. No. 963,540 published July 12, 1950 which includes openings in the walls of the diffuser to permit exhaust flow therefrom that is then re-introduced at another location in the compressor in an attempt to recover the energy of this exhausting fluid. While theoretically providing a slight increase in compressor range, such arrangements inherently have deleterious impact on compressor efficiency because of boundary layer alteration or removal. A similar effect is created by the structure disclosed in U.S. Pat. No. 2,453,524 and ASME Paper No. 74-GT-92 "Casing Modification for Increasing the Surge Margin of a Centrifugal Compressor in an Automotive Turbine Engine," C. A. Amann et al, 1974, which have openings in the diffuser side walls that cross zones of substantially different pressure prior to entering the diffuser passage. The openings are deliberately located to induce flow from one region of the diffuser to another. The resulting boundary layer removal and alteration, as in the French patent, has a deleterious impact on compressor efficiency due to resultant disturbances to the main field.

Though not as pertinent to the present invention, similar techniques of boundary layer removal or alteration employing external suction devices have been tried in stator sections of multiple axial compressors, as exemplified in U.S. Pat. No. 3,846,038. Many considerations of operational efficiency and aerodynamic flow through a radial diffuser and axial stator are distinctly different. The last-mentioned patent incorporates slots along isobars in an axial stator, but deliberately induces flow therefrom to alter or remove the boundary layer and thus reduce effective compressor efficiency.

SUMMARY OF THE INVENTION

In contrast to the above-described prior arrangements, the present invention contemplates compressor range improvement without substantially any interference with the major flow of the compressor and without significant reduction of compressor efficiency. Rather than removal or alteration of boundary layer flow as previously taught, the present invention minimizes interference with boundary layer flow to sustain compressor operational efficiency. The present invention increases compressor range by a completely different technique of assuring that surge or stall is not encountered until each and all vane passages are at design stall incidence.

More particularly, it is now known that because of imperfect manufacturing the diffuser of a centrifugal compressor will inherently have one or more "weaker" diffuser passages that tend to develop higher static pressure gradients and encounter design stall incidence prior to other diffuser passages. We have discovered that by interconnecting and equalizing the static pressure across the entrances of all the diffuser passages while minimizing interference with the associated boundary layer flows, stall incidence is not controlled by the "weaker" passages as might be expected, but rather stall is substantially delayed — apparently tending to be controlled by the "stronger" diffuser passages. This is accomplished in a preferred form of the invention by incorporating thin slot-like openings in the walls of the diffuser adjacent the entrances of the diffuser passages. The slots are disposed perpendicularly to the corresponding diffuser passage or at a similar position to be located on a substantially constant pressure line across the diffuser passage. All the slots communicate with a common plenum which is closed. Thus, this structure allows no substantial fluid flow through the slots and no interference with the major flow and boundary layers in the diffuser; but yet the entrances of all the slots are brought to substantially the same static pressure to increase compressor range.

Accordingly, an object of this invention is to provide a compressor diffuser construction which will eliminate, or at least reduce, the faulty operations pointed out above by smoothing out and equalizing the flow through the diffuser. With this construction the surge-free compressor operating range can be extended.

Another object of this invention is to provide a compressor diffuser having chamber and passage constructions which will reduce non-uniform flow characteristics and thus improve the operating efficiency of the compressor.

Still another object of the invention is to provide a compressor diffuser of the type having passages extending outwardly from the compressor impeller with one or more plenum chambers and ports establishing communication between the plenum chamber and the inlet ends of the diffuser passages whereby the pressure at such inlet ends of all the passages will be equalized.

A further object of the invention is to provide a compressor diffuser of the character mentioned in the preceding paragraph with slot-like ports for establishing communication between the plenum chamber and the diffuser passages and to orient and dispose such slot-like ports in a particular relation to the compressor impeller.

A still further object of the invention is to dispose a plenum chamber on each side of the diffuser and to locate the communication establishing slots also at each side so that all pressure differentials at the diffuser passage inlets will be minimized.

An object also is to establish communication between the plenum chambers on opposite sides of the diffuser in any suitable manner such as by providing communicating slots in some or all of the vanes in the diffuser which define the diffuser passages.

Other objects of the invention will be obvious from the following description of the form of the invention illustrated in detail in the accompanying drawing.

IN THE DRAWING

Figure 2:
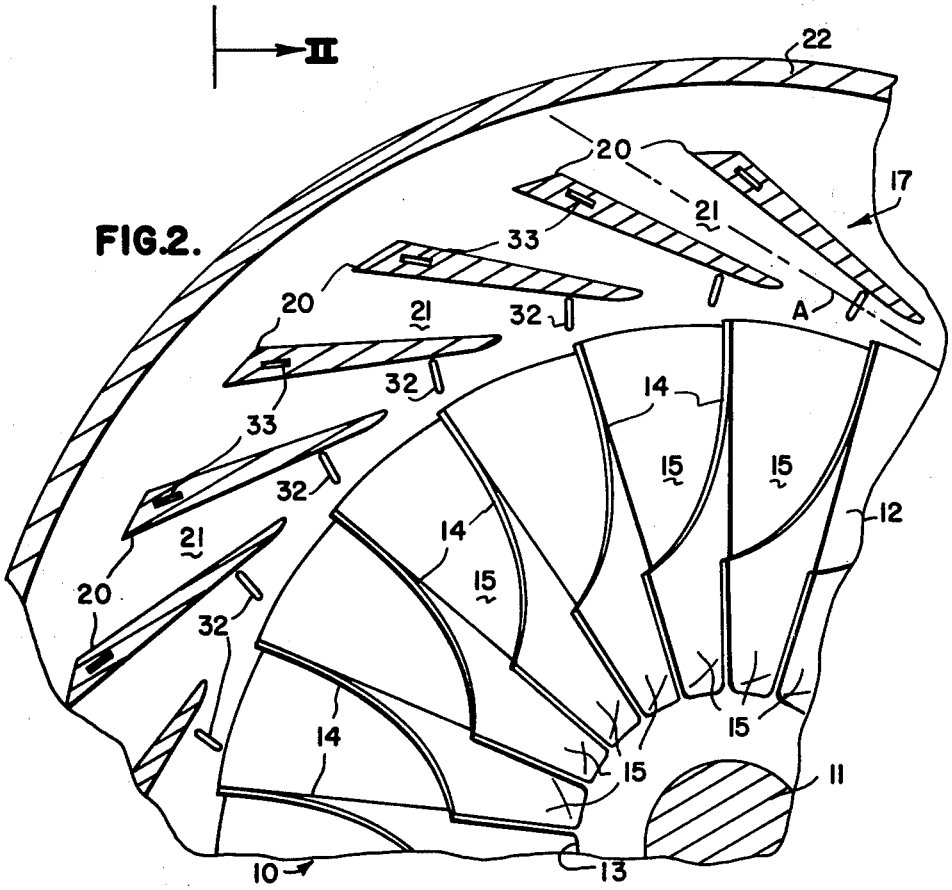

FIG. 1 is a fragmentary axial sectional view of a compressor impeller and its associated diffuser formed in accordance with the present invention; and FIG. 2 is a transverse sectional view taken through the impeller and diffuser shown in FIG. 1 on the plane indicated by the line II—II of such Figure.

DESCRIPTION OF THE DISCLOSURE

Particular reference to the drawing will show that a compressor to which the present invention has been applied includes an impeller 10 mounted for rotation with a drive shaft 11 which may be driven in any suitable manner by a prime mover (not shown). The impeller has a body 12 of generally disc-shaped configuration with a front surface 13 of cylindrical form adjacent the shaft and fairing into a radially extending surface at the periphery. A plurality of blades 14 project from the surface 13, these blades being spaced and extending generally radially of the impeller. They provide passages 15 through which fluid flows in response to the rotation of the impeller, as is well known in the art, the flow being caused by centrifugal force discharging the fluid from the periphery of the impeller and additional fluid flowing into the passages at the center of the wheel to replace that discharged. The blades 14 may be suitably curved in some instances to enhance the flow of fluid into the passage inlets.

In some compressor constructions a shroud 16 is provided adjacent the outer edges of the blades 14 to confine the fluid in the passages formed thereby. The shroud may either be a part of the wheel or separate therefrom, depending upon the desires of the manufacturer. It will be obvious from the foregoing that as the impeller rotates fluid will flow into the passages at the center of the impeller and be discharged at high velocity from the peripheral ends of the passages 15.

As is usual in the type of compressor shown, a diffuser element 17 is provided around the periphery of the impeller. The element 17 consists of spaced walls 18 and 19 which register substantially with the outer edges of the shroud 16 and the impeller disc body or hub. A plurality of vanes 20 extend between the walls 18 and 19 and cooperate therewith to provide diffuser passages 21. The vanes 20 extend outwardly of the diffuser and may be arranged generally tangential to the periphery of the impeller.

The passages receive the fluid discharged at high velocity from the impeller and convert the velocity to pressure, suitable collecting means 22 surrounding the outer portion of the diffuser to receive the fluid under pressure.

As the fluid flows from the impeller through the diffuser passages any variation in the surfaces of the walls or vanes may offer some resistance and cause a build-up of fluid along such surfaces. Even when the surfaces are completely smooth, boundary layer build-up may cause losses and impair the efficiency of the machine and minor manufacturing tolerances or other deviations may cause different boundary layer thicknesses between the various passages. Such flow resistance differences can cause surge or stall in one or more passages and precipitate a premature general stall condition. The invention herein is intended to counteract any tendency of the flow to surge or stall locally and thus increase the range of operation of the compressor prior to the occurrence of a general stall condition.

To accomplish this objective the diffuser is provided with additional walls 23 and 24 held spaced from walls 18 and 19 by walls 25, 26, 27, and 28 to provide plenum chambers 29 and 30, chamber 29 being on the shroud side of the impeller and chamber 30 being on the disc or hub side. These chambers are coextensive with the diffuser or, in other words, extend completely around the periphery of the impeller. Walls 18 and 19 are provided with openings 31 and 32 to establish communication between the diffuser passages 21 and the plenum chambers 29 and 30. Openings 31 and 32 comprise thin slots which are disposed at the inlet ends of the passages 21 a predetermined distance from the periphery of the impeller. The slots are also oriented to lie in planes extending substantially at right angles to the longitudinal axes or mean lines A of the passages which they connect with the plenum chambers. The inner ends of the diffuser vanes are located a preselected radial distance from the central rotational axis of the impeller and the planes of the slots intersect the longitudinal axes of the diffuser passages at this preselected radial distance from the central axis.

With this construction the inlet ends of the diffuser passages communicate with the chambers at the sides of the diffuser and the pressures at the inlet ends on such sides will be equalized. To equalize the pressures at opposite sides of the inlet ends of the diffuser passages, each diffuser vane is formed with a slot 33 near the outer end to establish communication between the chambers 29 and 30 on opposite sides of the diffuser. It will be seen from the foregoing that through the provision of the chambers, the slots which connect the inlet ends of the diffuser passages therewith, and the slots that establish communication between the chambers, the pressure in the inlet ends of all the diffuser passages will be equalized.

At high operating speeds, the surge flow is generally dictated by the diffuser configuration. By allowing communication between all diffuser passages near the inlet ends, the static pressure at this location will be the same for all the passages and the diffuser will not tend to stall until all the vane passages are at the design stall incidence.

Slots 32 are preferably quite thin and extend in a straight line across the full width of the corresponding passage 21. Slots 32 lie in a direction of nearly constant static pressure across passages 21. The particular direction of each slot 32 may vary slightly and can be determined by first determining the direction of most constant static pressure across the particular passage 21 in the absence of slot 32. It is preferable to locate each slot at substantially the same position relative to the diffuser passages 21 such that the values of the constant static pressures are most nearly equal.

As discussed above, however, imperfect manufacturing of the diffuser does not allow the static pressures in the diffuser passages to be equal even at the same radial locations. Such static pressure variations, which become more pronounced as the compressor nears its design stall incidence, create premature stall conditions at one or more passages. With incorporation of slots 32 and closed plenums 29 and 30, the present invention assures that the static pressures are maintained at the same value, and stall is not encountered until all the vane passages are at the design stall incidence.

By placement of slots 32 along lines of constant static pressure in the diffuser passages, and by the closing of plenums 29, 30 from communication other than with slots 32, actual fluid flow in and/or out of slots 32 is minimized. Substantially no interference with the boundary layers or other portions of the major flow through the diffuser occurs. No reduction in compressor efficiency results as there is no interference with diffuser flow, yet compressor range is significantly improved.

We claim:

1. In a compressor of the type having a centrifugal impeller and a diffuser at the periphery thereof, the diffuser including spaced sidewalls and spaced vanes extending therebetween, the spaces between the vanes having inlet ends adjacent the periphery of said impeller, the improvement comprising:

means in connection with said diffuser forming a plenum; and passage-forming means establishing communication between the inlet ends of the spaces between the diffuser vanes and said plenum to equalize the pressure in the inlet ends of all such spaces during the operation of the compressor, said passage-forming means extending along a substantially constant static pressure line across each of said spaces and said plenum being otherwise closed to minimize fluid flow from said plenum through said passage-forming means.

2. The compressor improvement defined in claim 1 in which the plenum-forming means is disposed to provide a plenum at each side of the diffuser.

3. The compressor improvement defined in claim 2 in which the passage-forming means establishes communication between the plenums at each side of the diffuser and the spaces between the diffuser vanes.

4. The compressor improvement defined in claim 2 in which at least a portion of said diffuser vanes have passages therein establishing communication between the plenums at the sides of the diffuser.

5. The compressor improvement defined in claim 1 in which the passage-forming means include slots in a side wall of the diffuser.

6. The compressor improvement defined in claim 5 in which each slot is located in a plane disposed at an angle to the longitudinal axis of the space between diffuser vanes communicating with such slot.

7. The compressor improvement defined in claim 6 in which the angle at which the plane of the slot is disposed is substantially 90 degrees.

8. In a compressor of the type having a centrifugal impeller and a diffuser at the periphery thereof, the diffuser including spaced sidewalls and spaced vanes extending therebetween, the spaces between the vanes having inlet ends adjacent the periphery of said impeller, the improvement comprising:

means in connection with said diffuser forming a plenum; and passage-forming means establishing communication between the inlet ends of the spaces between the diffuser vanes and said plenum to equalize the pressure in the inlet ends of all such spaces during the operation of the compressor, said passage-forming means extending along a substantially constant static pressure line across each of said spaces and said plenum being otherwise closed to minimize fluid flow from said plenum through said passage-forming means, said passage-forming means including slots in a side wall of the diffuser extending across the full width of the space between a pair of diffuser vanes.

9. In a compressor of the type having a centrifugal impeller and a diffuser at the periphery thereof, the diffuser including spaced sidewalls and spaced vanes extending therebetween, the spaces between the vanes having inlet ends adjacent the periphery of said impeller, the improvement comprising:

means in connection with said diffuser forming a plenum; and passage-forming means establishing communication between the inlet ends of the spaces between the diffuser vanes and said plenum to equalize the pressure in the inlet ends of all such spaces during the operation of the compressor, said passage-forming means extending along a substantially constant static pressure line across each of said spaces and said plenum being otherwise closed to minimize fluid flow from said plenum through said passage-forming means, said passage-forming means including slots in a side wall of the diffuser, each slot being located in a plane disposed at an angle of substantially 90 degrees to the longitudinal axis of the space between diffuser vanes communicating with such slot, each slot extending across the full width of the space between a pair of diffuser vanes.

10. The compressor improvement defined in claim 9, wherein said diffuser vanes have inner ends at a preselected radial distance from the compressor rotational axis, said slots being arranged in planes intersecting said longitudinal axis of the associated space at said preselected radial distance from said rotational axis.

11. In a compressor of the type having a centrifugal impeller and a diffuser at the periphery thereof, the impeller having hub and shroud sides, the diffuser including spaced sidewalls registering substantially with the hub and shroud sides of the impeller and spaced vanes extending between the sidewalls, the vanes having leading edges disposed a predetermined distance from the axis of rotation of the impeller and defining the inlet ends of the diffuser passages formed by the vanes, the improvement comprising:

means on the diffuser forming a chamber adjacent a side wall thereof, the chamber being substantially coextensive with the diffuser; and passage-forming means in the diffuser wall adjacent the chamber establishing communication between the chamber and each diffuser passage at the inlet end thereof, said passage-forming means comprising a thin slot at said inlet end of each diffuser passage extending along a substantially constant static pressure line across the associated diffuser passage, said chamber being otherwise substantially closed to minimize fluid flow from said chamber through said passage-forming means while substantially equalizing pressure at said inlet ends of said diffuser passages to counteract any tendency of formation of localized stall conditions at any one of said diffuser passages prior to occurrence of general stall conditions simultaneously in substantially all of said diffuser passages.

12. The compressor improvement defined in claim 11 in which the means on the diffuser forms a chamber adjacent each side wall thereof, both chambers being substantially coextensive with the diffuser and passage-forming means are provided in each diffuser wall to establish communication between the chamber adjacent thereto and each diffuser passage at the inlet end thereof.

13. The compressor improvement defined in claim 12 in which the passage-forming means consists of narrow slots each disposed in a plane at right angles to the longitudinal axis of the diffuser passage communicating therewith, the intersections of the planes of the slots and the longitudinal axes of the diffuser passages being the same distance from the axis of rotation of the impeller as the leading edges of the diffuser vanes.

* * * * *